United States Patent [19]

Mori

[11] Patent Number: 4,466,949

[45] Date of Patent: Aug. 21, 1984

[54] PROCESS FOR CONTINUOUSLY PRODUCING CARBON FIBERS

[75] Inventor: Yukiyoshi Mori, Ehime, Japan

[73] Assignee: Toray Industries, Inc., Tokyo, Japan

[21] Appl. No.: 415,583

[22] Filed: Sep. 7, 1982

[30] Foreign Application Priority Data

Sep. 16, 1981 [JP] Japan ..... 56-144603

[51] Int. Cl.[3] ..... D01F 9/14; D01F 9/22

[52] U.S. Cl. ..... 423/447.4; 423/447.6; 264/29.2

[58] Field of Search ..... 423/447.1, 447.2, 447.4, 423/447.6; 264/29.2, 167, DIG. 75; 28/271

[56] References Cited

U.S. PATENT DOCUMENTS 4,186,179 1/1980 Katsuki et al. ..... 423/447.4

4,335,089 6/1982 Maruyama et al. ..... 423/447.6

*Primary Examiner*—Edward J. Meros

*Assistant Examiner*—Steven Capella

*Attorney, Agent, or Firm*—Austin R. Miller

[57] ABSTRACT

A process for continuously producing carbon fibers which comprises interconnecting the rear end of a preceding precursor fibrous yarn with the front end of a subsequent precursor fibrous yarn and continuously calcining the successively interconnected precursor yarns. In said process, said rear end and said front end are doubled on each other so that said successive precursor yarns are connected with each other by means of a length of doubled portion or each of said rear and front ends is doubled on each end of a different type fibrous yarn capable of being calcined so that said successive yarns are connected with each other through said different type yarn by means of lengths of doubled portion, and said yarns are entangled at the doubled portion to integrally interconnect said successive precursor yarns, a tensile strength of said doubled and entangled portion after oxidation in an air atmosphere at about 230° to 250° C. for 100 to 200 minutes is at least 0.8 g/d.

17 Claims, 5 Drawing Figures

PROCESS FOR CONTINUOUSLY PRODUCING CARBON FIBERS

BACKGROUND OF THE INVENTION

The invention relates to a process for continuously producing carbon fibers, which is excellent in workability and productivity.

As the starting material for the production of carbon fibers, there have been used various fibrous yarns such as of acrylic fibers, pitch fibers, cellulosic fibers and polyvinyl alcohol fibers. These precursor fibrous yarns are usually fed to the production process of carbon fibers from a yarn package in which a yarn is wound up on a bobbin or spool or packed in a box in a holded and piled up state. Therefore, in order to convert such precursor yarns into carbon fibers by continuously calcining the precursor yarns, it is necessary to directly or indirectly interconnect the rear end of one wound or piled precursor yarn with the front end of another wound or piled precursor yarn.

The interconnection of the rear and front ends of the successive precursor yarns is generally carried out by tying them together. However, it is known that the knot formed by tying together may decrease the passability of the precursor yarns through calcining step and/or cause troubles such as the breakage and burning out of the yarns during the calcining step due to the excessive thermal accumulation in the knot. In order to overcome such troubles and to improve the operating efficiency of the carbon fiber production process, there have hitherto been proposed various methods in which: precursor yarns tied together at their ends are subjected to oxidizing, and thereafter, the knot is cut off and then the oxidized yarns are again tied together at their ends and subjected to carbonization, as disclosed in Japanese Examined Patent Publication (Kokoku) No. 53-23411; a nonflammable compound is applied to the tied portion of the precursor yarns, as disclosed in Japanese Unexamined Patent Publication (Kokai) No. 54-50624; and the rear and front ends of the precursor yarns are preliminarily heat treated and then tied together by means of a specific tying method, as disclosed in Japanese Unexamined Patent Publication No. 56-37315. However, these methods necessitate manual work for tying the precursor yarns, which inevitably lowers the workability of the process. In addition, the knots are often uneven in size and shape so that when an array of multiple precursor yarns is concurrently calcined, some of the knots are burnt out or broken or the passability of the yarns through the calcining step becomes low. Thus, the inventor has made extensive studies to develop a process for continuously producing carbon fibers, which does not have the above-mentioned problems, and has attained the present invention as the results of the studies.

SUMMARY OF THE INVENTION

It is an object of the present invention to provide a process for continuously producing carbon fibers, which can substantially avoid manual work for the interconnection of the successive precursor yarns, allows the interconnected precursor yarns to easily pass through the calcining step due to the fact that the interconnected portions have uniform strength, shape and size, and is excellent in workability, operating efficiency and productivity and particularly advantageous for the bulk production of carbon fibers by interconnecting an array of multiple precursor yarns.

It is another object of the present invention to provide a process for continuously producing carbon fibers, in which the number and type of the precursor yarns can easily be changed.

The above-mentioned objects of the present invention can be attained by a process for continuously producing carbon fibers according to the present invention, which process comprises interconnecting the rear end of a preceding precursor fibrous yarn with the front end of a subsequent precursor fibrous yarn and continuously oxidizing the successively interconnected precursor yarns in an active atmosphere and then carbonizing the oxidized yarns in an inactive atmosphere, in which said rear end and said front end are doubled on each other so that said successive precursor yarns are connected with each other by means of a length of doubled portion or each of said rear and front ends is doubled on each end of a different type fibrous yarn capable of being oxidized so that said successive precursor yarns are connected with each other through said different type yarn by means of lengths of doubled portion, and said yarns are entangled at the doubled portion to integrally interconnect said successive precursor yarns, and a tensile strength of said doubled and entangled portion after oxidation in an air atmospher at about 230° to 250° C. for 100 to 200 minutes in at least 0.8 g/d.

DESCRIPTION OF THE PREFERRED EMBODIMENTS

Figure 1:
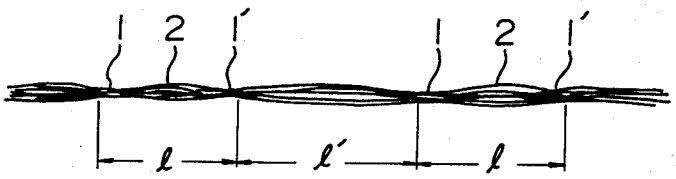
FIG. 1 is a plane view schematically illustrating a precursor yarn interconnected portion having two entangled portions.

In the process of the present invention, organic precursor yarns such as of acrylic fibers, cellulosic fibers and polyvinyl alcohol fibers may advantageously be employed, since they generate heat greatly during calcination, particularly during oxidation and, thus, the interconnected portion may often be broken due to thermal accumulation or the formation of tar-like material. However, the precursor fibrous yarns usable for the present invention are not limited to the above-mentioned yarns, and other precursor fibrous yarns of various pitch fibers can also be employed since in the process of the present invention the interconnection of the precursor yarns is easy and the passability of the yarns through the process is excellent.

The single filament denier of the individual filaments and the number of filaments in the precursor yarns are not critical so far as the yarns can be entangled by a fluid jet treatment as mentioned hereinafter. However, it is generally preferable that the single filament denier is not larger than 5 deniers, especially 0.1 to 3 deniers and the number of filaments is at least 300, especially 500 to 30,000.

According to one feature of the present invention, the successive precursor yarns may be interconnected by doubling the rear end of the preceding yarn on the front end of the subsequent yarn and subjecting the yarns at the doubled portion to entanglement by means of a fluid jet treatment. The fluid usable for the entanglement may include air, water, steam and the like, but air is preferred from the view point of workability and economy.

The rear end and front end of the successive precursor yarns may be doubled directly on each other. Alternatively, the successive precursor yarns may be indirectly connected by doubling the rear and front ends of the precursor yarns on the respective ends of a different type fibrous yarn capable of being entangled, preferably of an oxidized fibrous yarn obtained by heating the different type fibrous yarn in an oxidizing atmosphere.

Preferably, the interconnected portion by doubling and entanglement has a tensile strength of at least 0.8 g/d, preferably at least 1.0 g/d, after oxidation in an air atmosphere at 230° to 250° C. for 100 to 200 minutes. If the tensile strength is less than 0.8 g/d, the handleability or workability of the precursor yarns may become poor due to the poor strength of the interconnected portion and, in particular, the interconnected portion may be broken during the antiflaming step or the subsequent carbonization step.

In particular, when the ends of the successive precursor yarns are directly doubled on each other, the tensile strength of the interconnected portion may become poor due to the oxidation of the precursor yarns through heating. Thus, it is especially preferable that the interconnected portion has a tensile strength of not less than 2.0 g/d after entanglement. When the interconnected portion has a strength of at least 2.0 g/d before oxidation, the interconnected portion may usually have a tensile strength of at least 0.8 g/d after oxidization.

Contrary to this, it is possible that the ends of the successive precursor yarns are indirectly interconnected through a connecting yarn having a low heat-generation and a low shrinkage during the oxidation step, such as an oxidized yarn, even if such an oxidized yarn generally has a low tensile strength so that the interconnected portion before oxidation has a relatively low tensile strength, the reduction of the strength of the interconnected portion becomes small, instead, during antiflaming, since the heat-generation of the interconnected portion is low and the shrinkage of the interconnected portion including said oxidized yarn is low. Accordingly, when an oxidized yarn is employed as the connecting yarn, it may be satisfactory that the interconnected portion has a tensile strength of at least 0.8 g/d after oxidation. Preferably, such an oxidized yarn to be employed as the connecting yarn has a tensile strength of at least 0.8 g/d, more preferably 1.0 to 4 g/d, a specific gravity of not less than 1.3, especially 1.3 to 1.5 and a shrinkability at the oxidation step as low as possible, especially of not more than 10%. Further, such an oxidized connecting yarn preferably has a moisture content of 3.5 to 10% by weight.

The specific gravity of an oxidized yarn may be determined by drying about 1 g of an oxidized yarn in an air oven at 160° C. for 30 minutes and measuring the weight $W_1$ of the yarn in air by means of a specific gravity balance. Then, the sample yarn is dipped into ethanol (25° C.) and the weight $W_2$ in ethanol is measured. The specific gravity $\rho$ of ethanol is separately measured using an areometer. The specific gravity of the sample oxidized yarn is calculated by the equation, $$\text{Specific Gravity} = \frac{W_1}{W_2 - W_1} \times \rho$$

On the other hand, the moisture content may be measured as follows. An oxidized yarn sample is conditioned in an air atmosphere at 20° C. and 65% R.H., and the weight $m_1$ of the sample yarn is measured. Then, the sample yarn is dried in an oven at 120° C. for 2 hours and the weight $m_0$ is measured. The moisture content is calculated by the equation, $$\text{Moisture Content} = \frac{m_1 - m_0}{m_0} \times 100$$

The tensile strength as used herein refers to a value determined by measuring a maximum stress value by cramping the doubled and entangled precursor yarns at the positions of 2 cm apart from the respective ends of the entangled portion and pulling them at room temperature and at a speed of 20 cm/min, and dividing the obtained maximum stress value by the average denier value of the precursor yarns constituting the entangled porton. The determined tensile strength is indicated by an average value of not less than 20 samples. For the precursor yarns having entangled at plural positions, the measurement is carried out by cramping the yarns at the positions of 2 cm from the outermost ends of the entangled portions.

Figure 3:
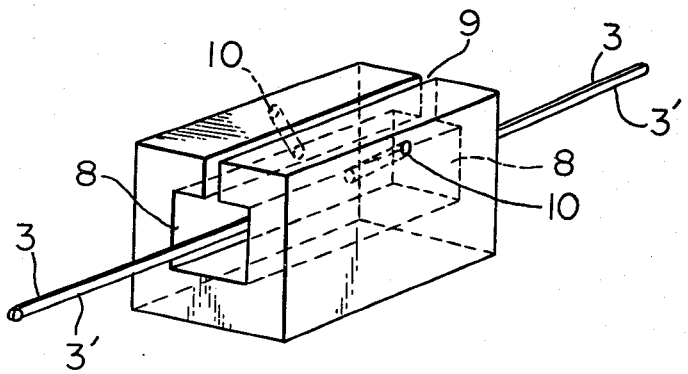
FIG. 3 is a perspective view schematically illustrating an air-interlacing apparatus usable for entanglement treatment.

The configuration of the entangled portion of the precursor yarns interconnected according to the present invention will now be illustrated below with reference to the accompanying drawings. FIG. 1 shows a configuration of a precursor yarn interconnected portion having two entangled portions which were interlaced by applying a relatively high air pressure to the doubled precursor yarns. In the case where the interlacing is effected using a general air jet apparatus (such as shown in FIG. 3), strong entanglement of the individual monofilaments is usually produced at two locations 1 and 1', but the intermediate portion 2 may have very weak entanglement of the filaments resulting from the migration of the filaments. Thus, the tensile strength of the interconnected portion may substantially be derived from the highly entangled portions 1 and 1'. The entangled portion as referred to herein is composed of the highly entangled portions 1 and 1' and the intermediate weakly entangled portion 2.

In FIG. 1, the entangled portion has a length of l and the interval between the two entangled portions has a length of l'.

A process and apparatus for treating strands with a turbulent gas stream are disclosed in Japanese Unexamined Patent Publication No. 51-147569. However, the disclosed process and apparatus are not directed to the yarns to be subsequently heat treated for oxidation, as in the present invention. In the present invention, it is very important for the production of carbon fibers that, during the oxidation of the precursor yarns, the heat generated from the oxidation reaction is dissipated from the reaction system. From such a point of view, the length of the entangled portion, the interval between the entangled portions and the like may be closely related with the possibility of attaining the objects of the present invention.

For example, the entangling treatment by a fluid jet may be carried out over a long zone, e.g. of about 5 to 100 cm, preferably about 10 to 50 cm, or strong entanglement may be applied to a plurality of short zones, e.g. of 1 to 5 cm. However, it is preferable that the doubled ends of the successive precursor yarns are entangled over a plurality of, e.g. not less than 2, short zones rather than over one long zone, considering the fact that the entangled portion may be burnt out due to thermal accumulation or be stiffened and embrittled due to the fixation of tar-like material during the oxidation of the precursor yarns having the entangled portion. On the other hand, when the ends of the successive precursor yarns are interconnected through an oxidized yarn, each of the doubled portions preferably has one entangled portion, since the relaxation of the oxidized connecting yarn occurs at the doubled portions during the oxidation due to the predominant shrinkage of the precursor yarns.

The length of the entangled portion may be varied as desired by transposing relatively the entangling apparatus and the doubled precursor yarns or by changing the construction of the entangling apparatus.

In the entanglement of the precursor yarns by a fluid jet, it is desirable that the entangled portion has a satisfactory tensile strength and that the entangled portion has a configuration as close as possible to that of one precursor yarn. However, it is also important, for precursor yarns of carbon fibers, that the precursor yarns have a satisfactory passability through the subsequent calcining step.

If the length of the highly entangled portions 1 and 1' is too large, there may often occur the burning out of the portions due to the thermal accumulation upon oxidation or the running out of grooves on rollers or damage by guides of the precursor yarns due to the stiffening of the portions through the fixation of tar-like material. On the other hand, if the length of the highly entangled portions is too small, the entangled portion may be broken by the slippage of the doubled yarns due to the tensioning force through the shrinkage of the yarns during the calcining step. Thus, in order to attain a high passability of the interconnected yarns through the calcining step, it is desirable that the entanglement is applied to a plurality of short zones with intervals of a prescribed length.

Preferably, the intervals between the entangled portions have a length of not less than 2 cm. If the length is too small, the interconnected yarns may have a low passability through the calcining step due to the running out of grooves on rollers or breakage of the precursor yarns, since the tar-like material produced during the oxidation step is not satisfactorily dissipated and the stiffened portions are close to each other. If the length is too large, e.g. of not less than 30 cm, the workability may undesirably be lowered.

Figure 2:
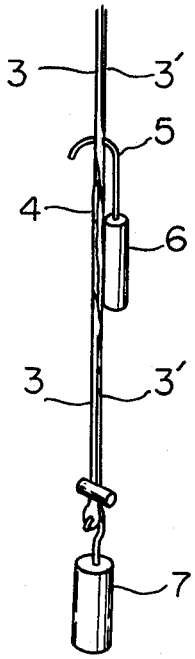
FIG. 2 is a perspective view schematically illustrating an apparatus for measuring the length of an entangled portion of doubled and entangled yarns.

The length of the entangled portion refers to a value measured as follows. Referring to FIG. 2, a load 7 of 1/60 g per total denier is cramped to be suspended at one end of doubled and entangled precursor yarns 3 and 3'. A hook 5 made of a wire having a diameter of 0.5 mm and a smooth surface and having another load 6 of 1/300 g per total denier is inserted between the unentangled precursor yarns to be suspended. Then, the position at which the suspended hook 5 stops is marked. Thereafter, the sample yarns are turned upside down and the above-mentioned procedure is repeated. Thus, the distance between the two marked positions is measured to obtain the length of the entangled portion. The length is indicated by an average value of not less than 20 samples except for the maximum and minimum values.

Figure 4:
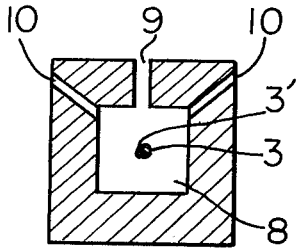
FIG. 4 is a vertical cross-section view of the apparatus shown in FIG. 3; and, FIG. 5 is a side view of the apparatus shown in FIG. 3.
Figure 5:
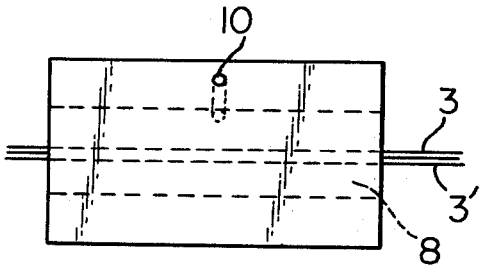

In the process of the present invention, the successive precursor yarns may advantageously be interconnected by doubling their ends and entangling the yarns at the doubled portion by means of a fluid jet nozzle for interlacing. As such a fluid jet nozzle, there may be employed various nozzles known, for example, from Japanese Examined Patent Publications Nos. 36-0511 and 37-1175. One example of the nozzles are shown in FIGS. 3 through 5.

Referring to FIGS. 3 through 5, 8 denotes a treating space, 9 denotes a yarn inlet, and 10 denotes air jetting holes. The doubled precursor yarns 3 and 3' to be interconnected are introduced into the treating space 8 through the yarn inlet 9, and interlaced by jetting a high-speed air flow from the air jetting holes 10. The treating space has a smooth inner surface so as to avoid the fluffing of the yarns and conventionally has a rectangular parallelepiped shape. However, the shape of the treating space is not limited to a rectangular parallelepiped shape.

The air jetting holes are not limited to the shape of a circular cross-section as shown in the figures but may have a slit-like shape. The air jetting may be effected not only in the direction perpendicular to the yarn axis but also in the direction with a more or less angle. Further, it is advantageous for workability that the edges of the yarn inlet are roundly shaved off for making the introduction of the yarns easy.

In the interlacing as mentioned above, it is important that the doubled portion of the precursor yarns within the interlacing zone is in a relaxed state, suitably with a relaxation percentage of 5 to 60%, preferably 10 to 40%. The relaxation percentage is calculated from the length of the doubled yarns in a relaxed state with respect to the original length of the doubled yarns. For example, in order to attain a relaxation percentage of 20% in an interlacing apparatus providing an interlaced or entangled portion of a length of 2 cm, the doubled precursor yarns should be set on the interlacing apparatus in a relaxed state so that a length of 2.4 cm of the precursor yarns is set in the interlacing zone of a length of 2.0 cm. However, it may be usual in a practical operation that the interlacing is effected by cramping the doubled precursor yarns at the positions of 1 to 2 cm apart from the respective ends of the portion to be interlaced. Thus, in the case where the doubled precursor yarns are to be cramped at the positions of 2 cm from the ends of the portion to be interlaced, a relaxation percentage of 20% is attained by cramping a length of 6.4 cm of the precursor yarns between the cramps of an interval of 6 cm. It is highly preferable, in the view point of operating efficiency, that the cramps for the treatment of the yarns in a relaxed state are provided directly to the interlacing apparatus and optionally designed so that the relaxation percentage is automatically set as desired.

The relaxed state of the doubled precursor yarns to be interlaced may be attained, without using a mechanical device, manually by holding the yarns with hands while empirically controlling the slack percentage. However, the interlaced portions prepared by such a manual operation may undesirably have uneven degree of entanglement.

Before introducing the interconnected successive precursor yarns into the oxidation step, the ends of the respective yarns outside of the entangled portion should be subjected to trimming to improve the passability of the interconnected yarns through the subsequent step. Upon the interconnection of the successive precursor yarns, the ends of the yarns are generally doubled with a length well larger than a length necessary for the entanglement so that free ends of the doubled precursor yarns are remained outside of the entangled portion in a length of several centimeters to 20 cm. Therefore, the free ends of the doubled yarns should be cut to a length of 0.2 to 0.5 cm from the ends of the entangled portion, e.g. by scissors after the entanglement operation to avoid undesirable problems such as the winding of the yarn round a roller or the like.

The appropriate air pressure to be applied to an air jet nozzle may vary depending upon the single filament denier of the yarn component filaments, the number of the yarn component filaments, the condition of the applied oiling agent, the shape of the air jet nozzle and the like. However, it is generally suitable that compressed air of a gauge pressure of not lower than 2 $kg/cm^2$, preferably 4 to 8 $kg/cm^2$ is fed to the air inlet portion of the nozzle. If the air pressure is too low, the entangled portion may have a poor tensile strength. If the air pressure is too high, the breakage of some of the individual filaments may occur at the entangled portion, which may cause a trouble such as the winding of the yarn round a roller at the subsequent step.

The thus interconnected precursor yarns are calcined, according to any of the known processes for the production of carbon fibers, to be converted into carbon fibers or graphite fibers. For example, the precursor yarns are heated in an oxidizing gas atmosphere at about 200° to 400° C. to form oxidized filamentary yarns, and then the oxidized yarns are heated for carbonizaton in an inert gas atmosphere at about 800° to 1500° C., and optionally, the carbonized filamentary yarns are heated in an inert gas atmosphere at a higher temperature to form graphite fibers.

According to the present invention, the drawbacks or problems of the conventional processes as mentioned hereinbefore can be overcome and, in addition, the following excellent effects can be obtained.

1. The operating efficiency of the process can be improved due to the improvement in the passability of the yarn through the calcining step, since the thickness and filament density of the interconnected portion are extremely low as compared with the conventional processes in which the successive precursor yarns are interconnected by tying their ends together and then continuously calcined.

2. The passability of the yarn through the carbonization step is excellent due to the improvement in the flexing resistance of the interconnected portion, while the flexing resistance and strength of the interconnected portion are deteriorated during the oxidation step in the conventional processes so as to decrease the passability of the yarn through the carbonization step.

3. The type of the precursor yarn, e.g. the total denier of the yarn, can easily be effected at the continuous calcining step. That is to say, the ends of two precursor yarns of different total deniers can be doubled and entangled to successively interconnect the yarns without taking the difference in the thickness of the yarns to be interconnected into consideration.

4. The operating efficiency of the process can be improved due to the improvement in the flexing resistance of the yarn at the carbonization step, since the respective entangled portions can have a small length by forming a plurality of entangled portions as shown in FIG. 1 so that the entangled portions have a low heat accumulation and a small fixation of tar-like material during calcining.

5. The resulting carbon fibers can have constant physical properties, since the strength, shape, size and the like of the interconnected portions become constant owing to the mechanical interconnecting operation through a fluid jet and, thus, the interconnected precursor yarns can be calcined under a constant tension.

The present invention will further be illustrated by way of the following non-limitative examples.

EXAMPLE 1

Acrylic filamentary yarns of 3,000 and 12,000 filaments having a single filament denier of 1.0 denier and a tensile strength of about 6 g/d were each subjected to doubling and entangling using an air-interlacing apparatus of the type as shown in FIG. 3, with varying the air pressure, the relaxation percentage of the yarn under interlacing, and the number of filaments, to obtain various interconnected yarn samples. The interconnected portion of each sample had one entangled portion and the length of the entangled portion was 2 cm.

One series of these samples were subjected to the measurement of tensile strength using a tensile tester. Another series of the samples prepared under the same conditions were fed, at a speed of 1.0 m/min, into an antiflaming furnace in which hot air at 240° C. was circulated. The samples were allowed to stay in the furnace for 150 minutes by being passed through rollers provided on the upper and lower portions of the furnace in a zigzag manner, and then were taken out from the furnace, while the tensile strength of the interconnected portion and the passability of the yarn samples through the oxidation step were determined.

Then, the samples were fed, at a speed of 1.0 m/min, into a carbonizing furnace having a substantial heating zone of a temperature distribution of from 500° C. to 1,400° C. and subjected to heat treatment for 1 minute, while the passability of the yarn samples through the carbonization step was determined.

The above-mentioned passability is indicated by the percentage of the yarn samples having interconnected portions which passed through the above-mentioned oxidation step or carbonization step without breakage, when the yarn samples were introduced into the step and heat treated.

The obtained results are shown in Table 1 below.

TABLE 1

| Run No. | Number of Filaments | Relaxation Percentage (%) | Air Pressure (Kg/cm²) | Tensile Strength Before Oxidation (g/d) | Tensile Strength After Oxidation (g/d) | Passability through Oxidation Step (%) | Passability through Carbonization Step (%) |
|---|---|---|---|---|---|---|---|
| 1 | 3000 | 20 | 1.5 | 2.1 | 1.0 | 94 | 100 |
| 2 | 3000 | 20 | 2.0 | 2.6 | 1.3 | 100 | 100 |
| 3 | 3000 | 20 | 2.5 | 3.2 | 1.5 | 100 | 100 |
| 4 | 3000 | 20 | 3.0 | 3.8 | 1.4 | 100 | 92 |
| 5 | 3000 | 20 | 3.5 | 4.1 | 1.2 | 100 | 80 |
| 6 | 3000 | 5 | 1.5 | 0.3 | * | 0 | * |
| 7 | 3000 | 5 | 2.0 | 0.5 | * | 0 | * |
| 8 | 3000 | 5 | 2.5 | 1.0 | * | 0 | * |
| 9 | 3000 | 10 | 2.0 | 1.4 | 0.7 | 20 | * |
| 10 | 3000 | 10 | 2.5 | 1.8 | 0.9 | 91 | 100 |
| 11 | 12000 | 20 | 1.5 | 2.2 | 1.0 | 96 | 100 |
| 12 | 12000 | 20 | 2.0 | 2.5 | 1.0 | 100 | 100 |
| 13 | 12000 | 20 | 2.5 | 2.7 | 1.3 | 100 | 100 |
| 14 | 12000 | 20 | 3.0 | 2.9 | 1.3 | 100 | 100 |
| 15 | 12000 | 20 | 3.5 | 3.4 | 1.1 | 100 | 88 |
| 16 | 12000 | 20 | 4.0 | 3.6 | 0.9 | 93 | 80 |
| 17 | 12000 | 5 | 2.0 | 0.3 | * | 0 | * |
| 18 | 12000 | 5 | 2.5 | 0.9 | * | 0 | * |
| 19 | 12000 | 10 | 2.0 | 1.4 | * | 10 | * |
| 20 | 12000 | 10 | 2.5 | 1.9 | 0.8 | 84 | 100 |

*The yarn samples could not be fed to the carbonization step because the passibility through the oxidation step was poor.

EXAMPLE 2

A yarn of 3,000 filaments having a single filament denier of 1.0 denier as used in Example 1 was subjected to doubling and interlacing using an air-interlacing as described in Example 1, with varying the relaxation percentage of the yarn under interlacing, to obtain interconnected yarn samples each having one entangled portion. The air pressure applied to the interlacing apparatus was 6 kg/cm². The resultant samples were then subjected to the measurement to tensile strength.

The results are shown in Table 2.

TABLE 2

| Run No. | Relaxation Percentage % | Tensile Strength g/d | Remark |
|---|---|---|---|
| 1 | 5 | 2.3 | |
| 2 | 10 | 3.1 | |
| 3 | 20 | 3.6 | |
| 4 | 40 | 3.2 | |
| 5 | 60 | 2.8 | |
| 6 | 3 | 1.7 | |
| 7 | 80 | 2.7 | Too large entanglement |

TABLE 2-continued

| Run No. | Relaxation Percentage % | Tensile Strength g/d | Remark |
|---|---|---|---|
| | | | of filament |

EXAMPLE 3

Acrylic filamentary yarns of 1,000, 3,000, 6,000 and 12,000 filaments having a single filament denier of 1.0 denier were subjected to doubling and interlacing using air-interlacing apparatus of the type as shown in FIG. 3 but having different sizes, under the conditions of an air pressure of 6 kg/cm² and a relaxation percentage of 20%, with varying the length of the entangled portion. The obtained samples each had one entangled portion.

One series of the samples were subjected to the measurement of tensile strength, and another series of the samples were subjected to oxidation and carbonization under the same conditions as in Example 1, while the passabilities through the oxidation and carbonization steps were determined.

The results are shown in Table 3.

TABLE 3

| Run No. | Number of Filaments | Length of Entangled Portion cm | Tensile Strength g/d Before Oxidation | Tensile Strength g/d After Oxidation | Passability through Oxidation Step % | Passability through Carbonization Step % |
|---|---|---|---|---|---|---|
| 1 | 1000 | 1.2 | 2.2 | 1.3 | 100 | 100 |
| 2 | 1000 | 2 | 2.4 | 1.2 | 100 | 100 |
| 3 | 1000 | 5 | 3.0 | 1.5 | 100 | 100 |
| 4 | 1000 | 0.7 | 1.8 | 0.8 | 90 | 88 |
| 5 | 1000 | 10 | 3.3 | 1.6 | 100 | 100 |
| 6 | 3000 | 1.3 | 2.2 | 1.1 | 100 | 100 |
| 7 | 3000 | 2 | 2.4 | 1.2 | 100 | 100 |
| 8 | 3000 | 5 | 2.8 | 1.3 | 100 | 100 |
| 9 | 3000 | 0.7 | 1.8 | 0.6 | 78 | 83 |
| 10 | 3000 | 10 | 2.9 | 0.9 | 98 | 96 |
| 11 | 6000 | 1.2 | 2.2 | 1.0 | 100 | 100 |
| 12 | 6000 | 2 | 2.5 | 1.3 | 100 | 100 |
| 13 | 6000 | 5 | 2.8 | 1.2 | 100 | 100 |
| 14 | 6000 | 0.8 | 1.4 | 0.5 | 68 | * |
| 15 | 6000 | 10 | 2.7 | 1.0 | 100 | 80 |
| 16 | 12000 | 1.2 | 2.4 | 0.7 | 98 | 100 |
| 17 | 12000 | 2 | 2.3 | 0.9 | 100 | 100 |
| 18 | 12000 | 5 | 2.8 | 0.7 | 98 | 82 |

TABLE 3-continued

| Run No. | Number of Filaments | Length of Entangled Portion cm | Tensile Strength g/d Before Oxidation | Tensile Strength g/d After Oxidation | Passability through Oxidation Step % | Passability through Carbonization Step % |
|---|---|---|---|---|---|---|
| 19 | 12000 | 0.7 | 1.6 | 0.4 | 45 | * |
| 20 | 12000 | 10 | 2.8 | 0.6 | 36 | * |

*The yarn samples could not be fed to the carbonization step because the passability through the oxidation step was poor.

EXAMPLE 4

Yarn as used in Example 3 were subjected to doubling and interlacing, using an air-interlacing apparatus of the type as shown in FIG. 3 having a nozzle providing a length of the entangled portion of 2 cm, under the conditions of an air pressure of 4 kg/cm$^2$ and a relaxation percentage of 20%. The interconnected portion of each sample had plural entangled portions and each of the entangled portions had strong entanglement at the ends and weak entanglement at the center, as shown in FIG. 1.

One series of the samples were subjected to the measurement of tensile strength, and another series of the samples were subjected to oxidation and carbonization under the same conditions as in Example 1, while the passabilities through the oxidation and carbonization steps were determined.

The results are shown in Table 4.

TABLE 4

| Run No. | Number of Filaments | Number of Entangled Portions | Distance between Filaments Portions cm | Tensile Strength g/d Before Oxidation | Tensile Strength g/d After Oxidation | Passability through Oxidation Step % | Passability through Carbonization Step % |
|---|---|---|---|---|---|---|---|
| 1 | 1000 | 2 | 2 | 4.4 | 1.7 | 100 | 100 |
| 2 | 1000 | 2 | 5 | 4.3 | 1.7 | 100 | 100 |
| 3 | 1000 | 2 | 10 | 4.0 | 1.5 | 100 | 100 |
| 4 | 1000 | 2 | 0.5 | 3.6 | 1.3 | 100 | 84 |
| 5 | 1000 | 2 | 1 | 3.8 | 1.5 | 100 | 100 |
| 6 | 3000 | 2 | 2 | 3.6 | 1.3 | 100 | 90 |
| 7 | 3000 | 2 | 5 | 3.4 | 1.2 | 100 | 100 |
| 8 | 3000 | 2 | 10 | 3.1 | 1.2 | 100 | 100 |
| 9 | 3000 | 2 | 0.5 | 3.2 | 0.9 | 100 | 24 |
| 10 | 3000 | 2 | 1 | 3.4 | 1.0 | 100 | 32 |
| 11 | 3000 | 3 | 2 | 4.0 | 1.5 | 100 | 100 |
| 12 | 3000 | 3 | 5 | 3.9 | 1.6 | 100 | 100 |
| 13 | 3000 | 3 | 10 | 3.3 | 1.3 | 100 | 100 |
| 14 | 3000 | 3 | 0.5 | 3.8 | 0.8 | 100 | 20 |
| 15 | 3000 | 3 | 1 | 3.9 | 1.0 | 100 | 32 |
| 16 | 6000 | 2 | 2 | 3.9 | 1.1 | 100 | 98 |
| 17 | 6000 | 2 | 5 | 4.0 | 1.4 | 100 | 100 |
| 18 | 6000 | 2 | 10 | 3.6 | 1.3 | 100 | 100 |
| 19 | 6000 | 2 | 0.5 | 3.6 | 0.6 | 100 | 14 |
| 20 | 6000 | 2 | 1 | 3.8 | 0.8 | 100 | 43 |
| 21 | 12000 | 2 | 2 | 2.8 | 0.8 | 100 | 86 |
| 22 | 12000 | 2 | 5 | 2.7 | 0.9 | 100 | 96 |
| 23 | 12000 | 2 | 10 | 2.7 | 1.1 | 100 | 100 |
| 24 | 12000 | 2 | 0.5 | 2.9 | 0.4 | 96 | 0 |
| 25 | 12000 | 2 | 1 | 3.0 | 0.6 | 100 | 30 |

EXAMPLE 5

Yarns as used in Example 3 were subjected to oxidation treatment under the same conditions as in Example 1. The obtained oxidized yarns had a tensile strength of 2.5 g/d, a heat-shrinkage of 0% and a moisture content of 6.2%. Each of the oxidized yarns and each of the material yarns before oxidation were doubled, and then subjected to interlacing using an air-interlacing apparatus of the type as shown in FIG. 3, under the conditions of an air pressure of 4 kg/cm$^2$ and a relaxation percentage of 20%. The interconnected portion of each of the resultant samples had one entangled portion. For the obtained samples, the tensile strength of the interconnected portion was measured. Further, the samples were subjected to oxidation and carbonization under the same conditions as in Example 1, while the passabilities through the oxidation and carbonization steps were determined.

For comparison, each of the above-mentioned material yarns was interconnected by double genuine knots, and for these samples, the above-mentioned evaluations were effected.

The obtained results are shown in Table 5 below.

TABLE 5

| Run No. | Interconnected Yarns | Number of Filaments | Tensile Strength g/d Before Oxidation | Tensile Strength g/d After Oxidation | Passability through Oxidation Step % | Passability through Carbonization Step % |
|---|---|---|---|---|---|---|
| 1 | Interlacing, Oxidized yarn/ Material yarn | 1000 | 2.3 | 1.5 | 100 | 100 |
| 2 | | 3000 | 1.7 | 1.3 | 100 | 100 |
| 3 | | 6000 | 1.4 | 0.8 | 100 | 100 |
| 4 | | 12000 | 1.0 | 0.6 | 100 | 90 |
| 5 | Double knotting, Material yarn | 1000 | 2.4 | 0.5 | 94 | 0 |
| 6 | | 3000 | 2.5 | 0.4 | 64 | * |
| 7 | | 6000 | 2.5 | 0.3 | 50 | * |
| 8 | | 12000 | 2.6 | — | 0 | * |

*The yarn samples could not be fed to the carbonization step because the passability through the oxidation step was poor.

I claim:

1. A process for continuously producing carbon fibers comprising interconnecting the rear end of a preceding precursor fibrous yarn with the front end of a subsequent precursor fibrous yarn;

continuously oxidizing the successively interconnected precursor yarns in an active atmosphere; and carbonizing the oxidized yarns in an inactive atmosphere, wherein said rear end and said front end are doubled on each other so that said successive precursor yarns are connected with each other by means of a length of doubled portion and said yarns are entangled by application of fluid jet treatment at the doubled portion, said doubled portion being in a relaxed state, to integrally interconnect said successive precursor yarns, and to provide a tensile strength of said doubled and entangled portion after oxidation in an air atmosphere at about 230° to 250° C. for 200 minutes of at least 0.8 g/d.

2. A process for continuously producing carbon fibers comprising interconnecting the rear end of a preceding precursor fibrous yarn with the front end of a subsequent precursor fibrous yarn;

continuously oxidizing the successively interconnected precursor yarns in an active atmosphere; and carbonizing the oxidized yarns in an inactive atmosphere, wherein each of said rear and front ends is doubled on each end of a connecting yarn capable of being oxidized so that said successive precursor yarns are connected with each other through said connecting yarn by means of lengths of doubled portion, and said yarns are entangled by application of fluid jet treatment at doubled portion, said doubled portion being in a relaxed state, integrally interconnecting said successive precursor yarns, and to provide a tensile strength of said doubled and entangled portion after oxidation in an air atmosphere at about 230° to 250° C. for 200 minutes of at least 0.8 g/d.

3. A process as claimed in claim 1, or 2 wherein said doubled and entangled portion has a length of about 5 to 100 cm.

4. A process as claimed in claim 3, wherein said length of said doubled and entangled portion is about 10 to 50 cm.

5. A process as claimed in claim 1 or 2, wherein said fibrous yarns are interconnected at said doubled portion by means of multiple entangled portions of different degrees of entanglement.

6. A process as claimed in claim 5, wherein said entangled portions have a length of about 1 to 5 cm and are formed at at least two locations with an interval of about 2 to 30 cm.

7. A process as claimed in claim 1, or 2 wherein a tensile strength of said doubled and entangled portion before oxidation is at least 2.0 g/d.

8. A process as claimed in claim 7, wherein said strength is 2 to 5 g/d.

9. A process as claimed in claim 2, wherein said connecting yarn capable of being oxidized is an oxidized fibrous yarn having a moisture content of about 3.5 to 10% by weight and a tensile strength of at least 0.8 g/d.

10. A process as claimed in claim 9, wherein said tensile strength of said oxidized yarn is about 1.0 to 4.0 g/d.

11. A process as claimed in claim 1 or 2, wherein said fluid jet treatment is air jet treatment with compressed air having a gauge pressure of not lower than 2 kg/cm$^2$.

12. A process as claimed in claim 11, wherein said gauge pressure of said compressed air is in a range of 4 to 8 kg/cm$^2$.

13. A process as claimed in claim 1 or 2, wherein said yarns of said doubled portion are entangled in a slackened state at a slack percentage of 5 to 60%.

14. A process as claimed in claim 13, wherein said slack percentage is 10 to 40%.

15. A process as claimed in claim 1, or 2 wherein said precursor yarns consist of a filamentary fiber bundle of 500 to 30,000 individual filaments having a single filament denier of 0.1 to 3 deniers.

16. A process as claimed in claim 1, or 2 wherein said precursor yarns to be interconnected are different from each other in the single filament denier.

17. A process as claimed in claim 1 or 2, wherein said precursor yarns to be interconnected are different from each other in the number of individual filaments.

* * * * *